US007992716B2

(12) United States Patent
Jackson

(10) Patent No.: US 7,992,716 B2
(45) Date of Patent: Aug. 9, 2011

(54) RETAIL SHIPPER DISPLAY CONTAINER

(75) Inventor: Keith A. Jackson, Gurnee, IL (US)

(73) Assignee: Packaging Corporation of America, Lake Forest, IL (US)

( * ) Notice: Subject to any disclaimer, the term of this patent is extended or adjusted under 35 U.S.C. 154(b) by 608 days.

(21) Appl. No.: 12/069,978

(22) Filed: Feb. 14, 2008

(65) Prior Publication Data

US 2008/0197182 A1 Aug. 21, 2008

Related U.S. Application Data

(60) Provisional application No. 60/901,407, filed on Feb. 15, 2007.

(51) Int. Cl.
*B65D 75/58* (2006.01)

(52) U.S. Cl. ..... 206/738; 206/746; 206/774; 229/122; 229/120.11; 229/120.18

(58) Field of Classification Search ..... 206/738, 206/745, 746, 736, 754, 774, 730, 527, 526, 206/752, 751, 739; 229/122, 122.1, 120.09–120.11, 229/200, 242–244, 120.18, 240
See application file for complete search history.

(56) References Cited

U.S. PATENT DOCUMENTS

| | | | | |
|---|---|---|---|---|
| 4,058,206 | A * | 11/1977 | Morse et al. | 229/241 |
| 4,191,288 | A | 3/1980 | Hostad | 206/45.22 |
| 4,645,122 | A | 2/1987 | Nederveld | 206/509 |
| 4,884,739 | A | 12/1989 | Nederveld | 229/109 |
| 5,263,612 | A | 11/1993 | Nederveld | 229/112 |
| 5,277,360 | A | 1/1994 | DeMott | 229/122 |
| 5,458,283 | A | 10/1995 | Southwell et al. | 229/178 |
| 6,168,027 | B1 * | 1/2001 | Esser | 206/738 |
| 6,286,753 | B1 | 9/2001 | Jackson et al. | 229/174 |
| 6,302,323 | B1 | 10/2001 | Southwell | 229/164 |
| 6,371,365 | B1 * | 4/2002 | Doucette et al. | 229/120.011 |
| 6,375,068 | B2 | 4/2002 | Jackson et al. | 229/174 |
| D461,126 | S * | 8/2002 | Decello et al. | D9/432 |
| 6,581,772 | B2 | 6/2003 | Noland | 206/509 |
| 6,604,675 | B2 | 8/2003 | Southwell | 229/164 |
| 6,676,012 | B1 | 1/2004 | Southwell et al. | 229/120.17 |
| 6,808,107 | B2 | 10/2004 | Jackson | 229/169 |
| 7,080,736 | B2 | 7/2006 | Jackson et al. | 206/738 |
| 7,081,077 | B2 | 7/2006 | Jackson et al. | 493/68 |
| 7,172,110 | B2 | 2/2007 | Jackson | 229/169 |
| 7,549,542 | B2 * | 6/2009 | Gasior et al. | 206/746 |
| 2007/0007166 | A1 | 1/2007 | Bucalo | 206/736 |

* cited by examiner

*Primary Examiner* — Mickey Yu
*Assistant Examiner* — Chun Cheung
(74) *Attorney, Agent, or Firm* — Nixon Peabody LLP

(57) ABSTRACT

A container comprising a front panel, a first back panel, a second back panel, a first side panel bridging the front panel and the first back panel, a second side panel bridging the front panel and the second back panel, a top portion, and a bottom portion. The front panel, first and second back panels, first and second side panels, top portion, and bottom portion define an interior of the container. The container further comprises a divider extending from the first back panel into the interior of the container and attached to the front panel. The container further comprises a detachable portion comprising a removable section of the top portion, a removable section of the front panel, and a removable section of the divider. The detachable portion is separable from the container along a plurality of lines of weakness.

23 Claims, 8 Drawing Sheets

RETAIL SHIPPER DISPLAY CONTAINER

CROSS-REFERENCE TO RELATED APPLICATION

This application claims the benefit of U.S. Provisional Application No. 60/901,407, filed Feb. 15, 2007, which is incorporated by reference in its entirety.

FIELD OF THE INVENTION

The present invention relates generally to containers for retaining, shipping, and displaying goods and methods for making such containers. In particular, the present invention relates to a retail shipper display container.

BACKGROUND OF THE INVENTION

Flat sheets of corrugated paperboard, typically referred to as blanks, have been used for many years as the starting material to form containers. Corrugated paperboard generally refers to a multi-layer sheet material comprised of two sheets of liner bonded to a central corrugated layer of medium. A basic size requirement is generally specified by the customer, industry standards, and the preference for low cost, paperboard containers. Thus, manufacturers strive to provide structural stacking strength with a minimal amount of corrugated paperboard. A typical well-known container is a single-piece tray design having a bottom wall, two side walls, and two end walls each hinged to the bottom wall. Typically, a single piece of corrugated paperboard will be cut and scored to form a flat blank that will then be erected into this type of container.

One type of container—a retail shipper display (RSD) container—is typically used for packing, storing, shipping, and displaying goods. One type of existing RSD container includes a removable access panel die cut into one or more sides of the container along a line of weakness. It is desirable that the access panel be removable without significant effort by a user and without the use of tools. It is further desirable that the access panel and the lines of weakness defining the access panel be sufficiently sturdy to withstand the hazards associated with the distribution chain, both internal and external to the container. These hazards attempt to prematurely push the access panel out of the plane of the container side, thereby causing the contents of the container to become exposed or fall out.

One drawback to existing RSD containers is that increasing the ease with which the access panel may be removed also increases the likelihood that the access panel will prematurely rupture at the line of weakness. Conversely, strengthening the line of weakness makes it more difficult for a user to remove the access panel from the container, often requiring the use of additional tools.

Another disadvantage associated with existing RSD containers is that the side of the container from which the access panel is removed often becomes significantly weakened. Thus, when such RSD containers are stacked, RSD containers stacked above often nest into RSD containers stacked below. The stacked RSD containers thus appear crooked and disorderly and are more likely to fall over. To assist in preventing such a weakened panel, some existing RSD containers are constructed out of heavier and/or thicker materials. This solution, however, adds substantial costs to the manufacturing process.

Yet another disadvantage of typical RSD containers is that, when the access panel is removed, a rough edge is formed along the corresponding line of weakness. This rough edge is not aesthetically pleasing and may be undesirable from a marketing perspective for certain customers.

Thus, it would be desirable to provide a retail shipper display container that addresses one or more of the above disadvantages.

SUMMARY OF THE INVENTION

According to one embodiment of the present invention, a container is disclosed. The container comprises a front panel, a first back panel, a second back panel, a first side panel bridging the front panel and the first back panel, a second side panel bridging the front panel and the second back panel, a top portion, and a bottom portion. The front panel, first and second back panels, first and second side panels, top portion, and bottom portion define an interior of the container. The container further comprises a divider extending from the first back panel into the interior of the container and attached to the front panel. The divider is operable to divide the interior of the container into two or more compartments. The container further comprises a detachable portion comprising a removable section of the top portion, a removable section of the front panel, and a removable section of the divider. The detachable portion is separable from the container along a plurality of lines of weakness.

According to another embodiment of the present invention, a container is disclosed. The container comprises a front panel, a first back panel, a second back panel, a first side panel bridging the front panel and the first back panel, and a second side panel bridging the front panel and the second back panel. The front panel includes first and second front end panels positioned along opposing vertical ends of the front panel, first and second access openings positioned adjacent to inner ends of the first and second front end panels, and an access panel positioned between the first and second access openings. The container further comprises a top portion comprising a first top flap extending from the front panel, a second top flap extending from the first back panel, a third top flap extending from the second back panel, a fourth top flap extending from the first side panel, and a fifth top flap extending from the second side panel. The container further comprises a bottom portion comprising a first bottom flap extending from the front panel, a second bottom flap extending from the first back panel, a third bottom flap extending from the second back panel, a fourth bottom flap extending from the first side panel, and a fifth bottom flap extending from the second side panel. The container further comprises a divider hingedly coupled to the first back panel. The divider is separated into a first divider portion and a second divider portion by a line of weakness. The first divider portion is attached to an interior surface of the front panel. The container further comprises a detachable portion including at least a portion of the first top flap, the access panel, and the first divider portion.

According to yet another embodiment of the present invention, a container is disclosed. The container comprises a front panel, an opposing back panel, a first side panel bridging the front and the back panels, and a second side panel bridging the front and the back panels. The front panel includes first and second front end panels positioned along opposing vertical ends of the front panel and an access panel positioned between the first and second access openings. The container further comprises a top portion comprising a first top flap extending from the front panel, a second top flap extending from the back panel, a third top flap extending from the first side panel, and a fourth top flap extending from the second side panel. The first top flap includes a main portion and opposing first and second support panels hingedly coupled to the respective first and second end panels. The first and second support panels are separated from the main portion by respective lines of weakness. The container further comprises a bottom portion comprising a first bottom flap extending from the front panel, a second bottom flap extending from the back panel, a third bottom flap extending from the first side panel, and a fourth bottom flap extending from the second side panel. The container further comprises a detachable portion comprising the main portion of the top portion and the access panel. The detachable portion is separable from the container along a plurality of lines of weakness.

According to one process of the present invention, a method of using a container is disclosed. The method comprising the act of providing a container having a front panel, a first back panel, a second back panel, a first side panel bridging the front panel and the first back panel, a second side panel bridging the front panel and the second back panel, a top portion, a bottom portion, and a divider. The front panel, first and second back panels, first and second side panels, top portion, and bottom portion define an interior of the container. The divider extends from the first back panel into the interior of the container and is attached to the front panel. The divider is operable to divide the interior of the container into two or more compartments. The method further comprises the act of converting the container from a shipper configuration to a display configuration by detaching a detachable portion. The detachable portion comprising a removable section of the top portion, a removable section of the front panel, and a removable section of the divider. The detachable portion is separable from the container along a plurality of lines of weakness.

According to another process of the present invention, a method of using a container is disclosed. The method comprises the act of providing a container comprising a front panel, an opposing back panel, a first side panel bridging the front and the back panels, a second side panel bridging the front and the back panels, a top portion, and a bottom portion. The front panel includes first and second front end panels positioned along opposing vertical ends of the front panel and an access panel positioned between the first and second access openings. The top portion comprises a first top flap extending from the front panel. The first top flap includes a main portion and opposing first and second support panels hingedly coupled to the respective first and second end panels. The first and second support panels are separated from the main portion by respective lines of weakness. The method further comprises the acts of converting the container from a shipper configuration to a display configuration by removing a detachable portion. The detachable portion comprises the main portion of the top portion and the access panel. The detachable portion is separable from the container along a plurality of lines of weakness.

The above summary of the present invention is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
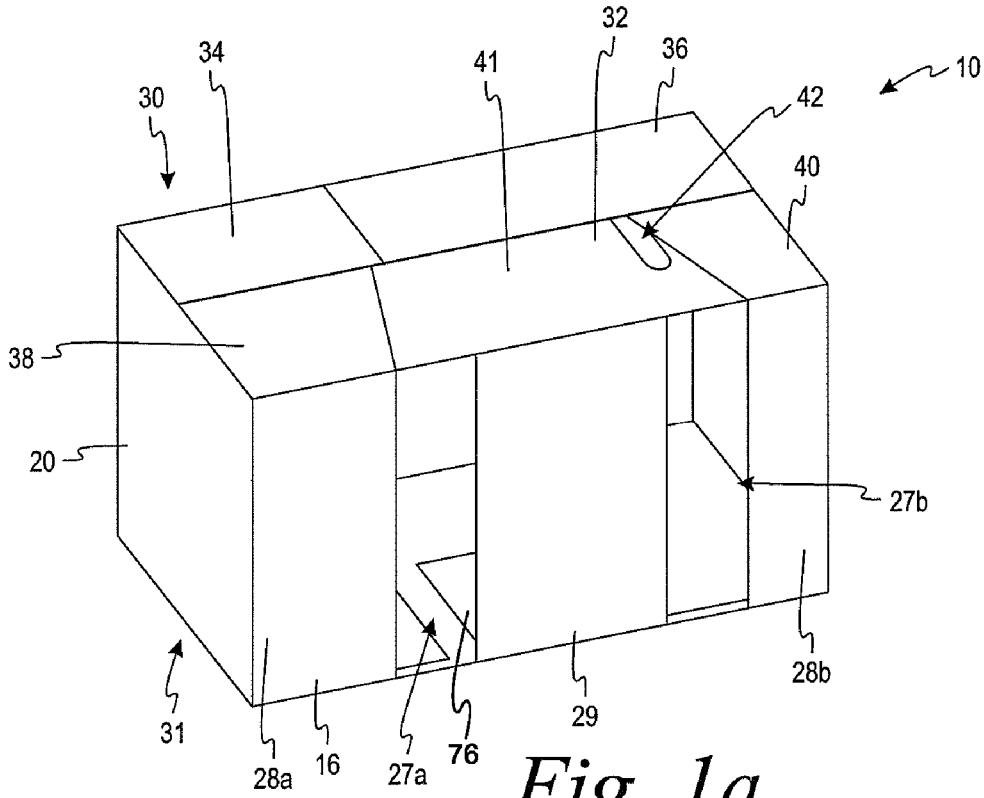
FIG. 1*a* is a top perspective view of a retail shipper display container in a shipper configuration according to one embodiment of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Figure 1B:
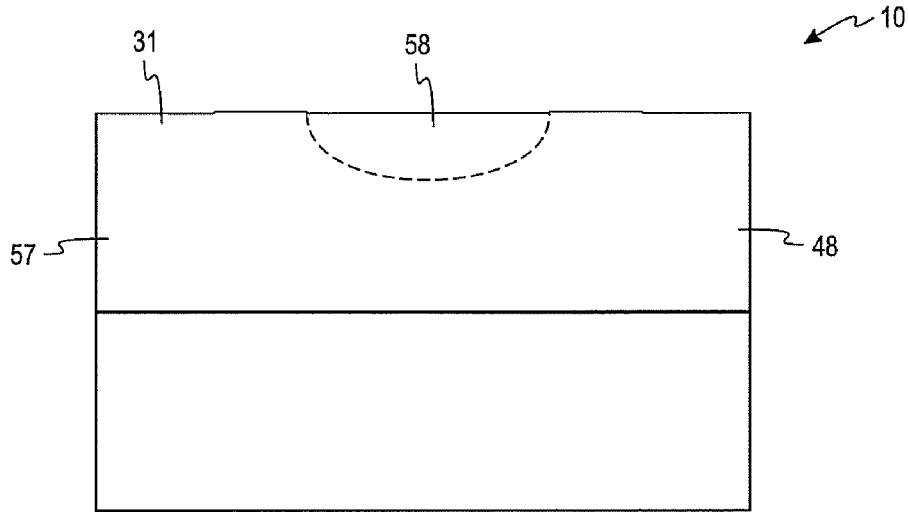
FIG. 1*b* is a bottom view of the container of FIG. 1*a*.
Figure 1C:
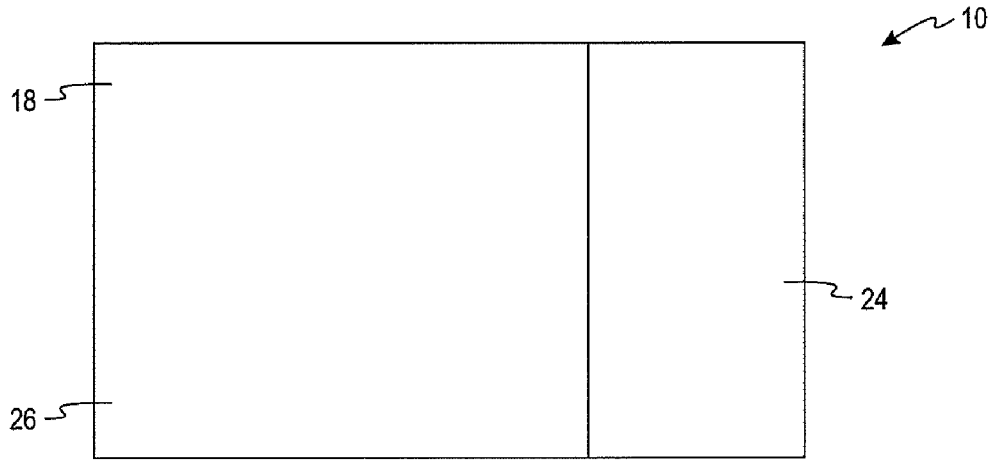
FIG. 1*c* is a rear view of the container of FIGS. 1*a* and 1*b*.

Turning now to FIGS. 1*a-c*, a non-limiting example of a retail shipper display container 10 according one embodiment of the present invention is shown. The container 10 is adapted to store and ship a plurality of items intended for sale from a manufacturer to a retail location. Once the container 10 arrives at the retail location, the container 10 may be converted into a display configuration so that the items may be displayed, dispensed, and sold to a consumer. The container 10 is adapted for easy conversion from a shipper configuration to a display and dispensing configuration. The container 10 is adapted to be placed on a counter top or on shelving at an appropriate height. The container 10 may also be stacked on top of other containers, structures, or the like.

According to one embodiment of the present invention, the container 10 of FIGS. 1*a*-3*b* comprises a front panel 16, a back side 18, a first side panel 20, and a second side panel 22. The back side 18 is located opposite the front panel 16. The back side 18 includes a first back panel 24 adhesively attached to a second back panel 26. In one embodiment, the combined width of the first and second back panels 24, 26 is slightly larger than the width of the opposing front panel 16 so that the first and second back panels 24, 26 slightly overlap, which may assist in attaching the first and second back panels 24, 26. The first side panel 20 bridges the front panel 16 and the first back panel 24. The second side panel 22 bridges the front panel 16 and the second back panel 26.

In the shipper configuration of FIGS. 1*a-c*, the front panel 16 includes two access openings 27*a*, 27*b* adapted to allow the contents of the container 10 to be viewed. The access openings 27*a*, 27*b* separate the front panel 16 into sections including first and second front end panels 28*a*, 28*b* positioned along opposing vertical ends of the front panel 16 and a generally central access panel 29 positioned between the access openings 27*a*, 27*b*.

Figure 4:
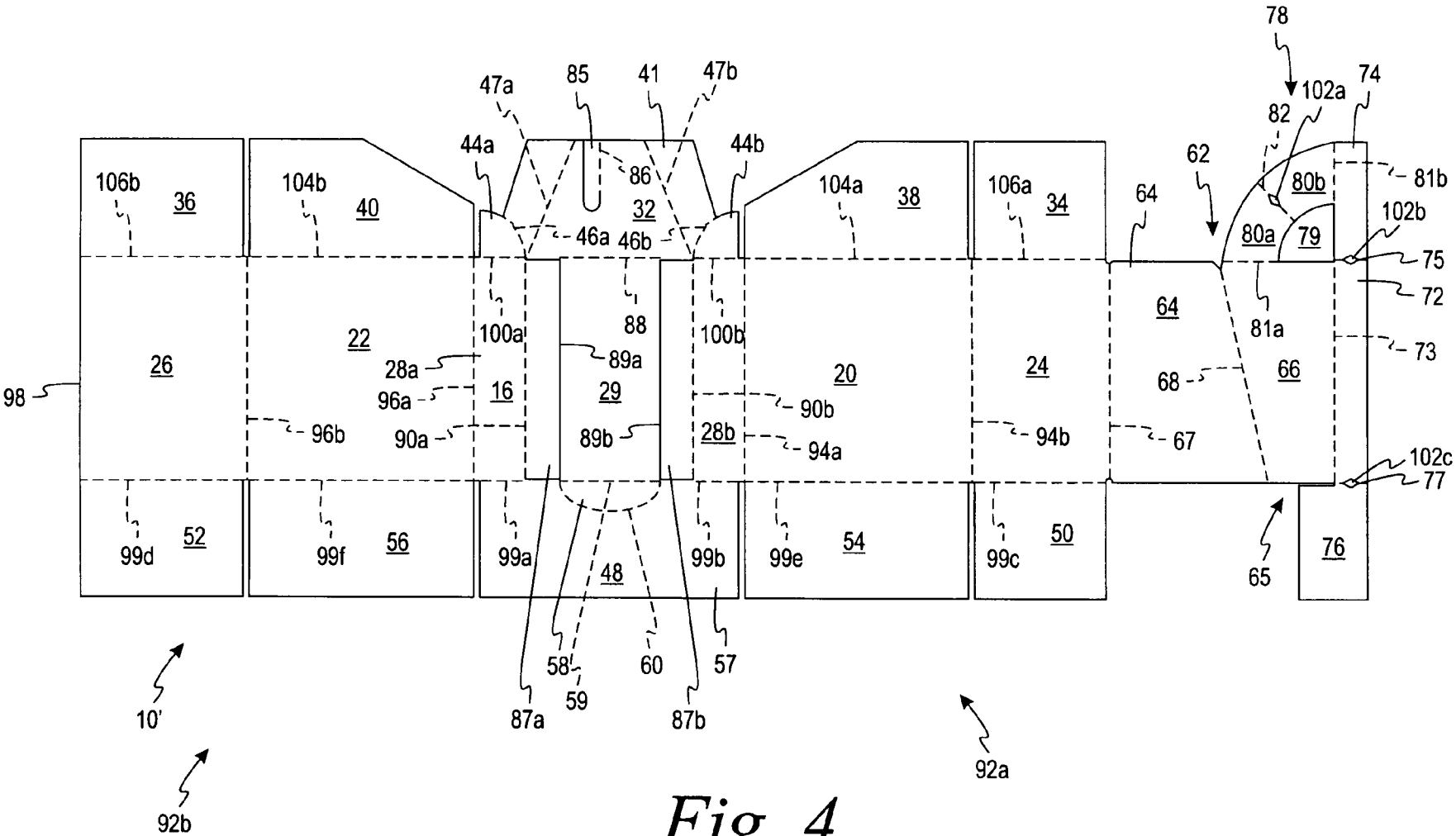
FIG. 4 is a plan view of a blank for forming the container of FIGS. 1*a*-1*c*.

The container 10 also includes a top side 30 and a bottom side 31. The top side 30 is comprised of a first top flap 32, a second top flap 34, a third top flap 36, a fourth top flap 38 and a fifth top flap 40. The first top flap 32 extends from the front panel 16. The second and third top flaps 34, 36 extend from the first and second back panels 24, 26, respectively. The fourth and fifth top flaps 38, 40 extend from the first and second side panels 20, 22, respectively. The first top flap 32 includes a main top portion 41 and an opening 42 adapted to allow a user to grasp the first top flap 32. The opening 42 may include a notch, a slit, or the like. The first top flap 32 further includes two support panels 44*a*, 44*b*. Respective lines of weakness 46*a*, 46*b* separate the support panels 44*a*, 44*b* from the main top portion 41 of the first top flap 32. The lines of weakness described herein may include perforation, scored lines, cut lines, tear lines, reverse cut, combinations thereof, or the like. The first top flap 32 further includes fold lines 47*a*, 47*b* extending from a corner of the respective support panels 44*a*, 44*b*. Although not necessary, the fold lines 47*a*, 47*b* may be generally parallel to the opposing sides of the main portion 41, as shown in FIG. 4.

The bottom side 31 of the container 10 is comprised of a first bottom flap 48, a second bottom flap 50, a third bottom flap 52, a fourth bottom flap 54, and a fifth bottom flap 56. The first bottom flap 48 extends from the front panel 16. The second and third bottom flaps 50, 52 extend from the first and second back panels 24, 26 respectively. The fourth and fifth bottom flaps 54, 56 extend from the first and second side panels 20, 22, respectively. The first bottom flap 48 includes a main bottom portion 57 and an optional run-over portion 58. The run-over portion 58 is hingedly coupled to the access panel 29 by a fold line 59. The run-over portion 58 is separated from the main bottom portion 57 by a line of weakness 60.

Figure 6A:
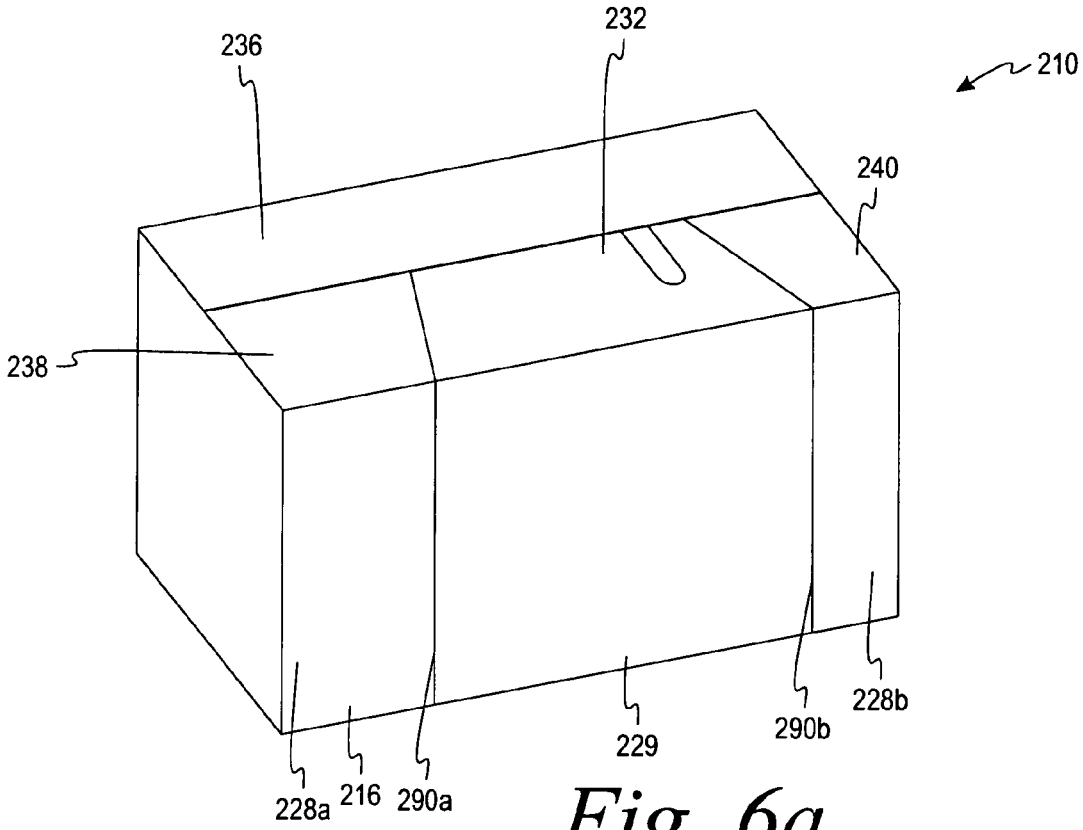
FIG. 6*a* is a top perspective view of a container according to yet another embodiment of the present invention.
Figure 6B:
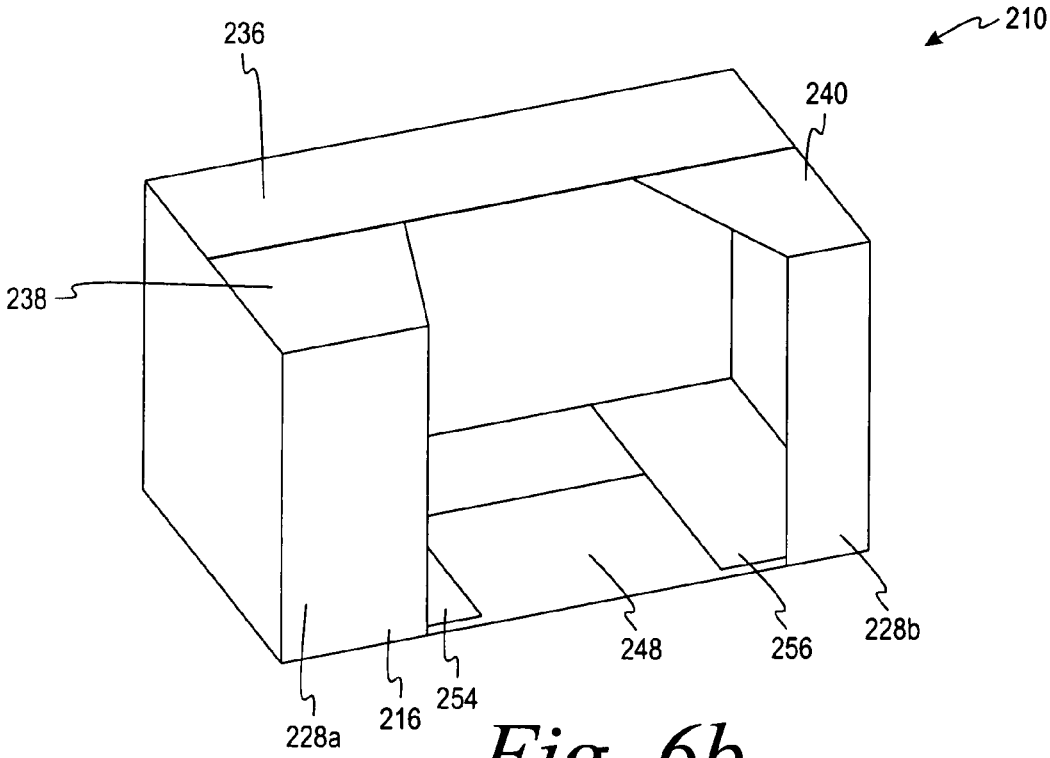
FIG. 6*b* is a top perspective view of the container of FIG. 6*a* in a display configuration.
Figure 6C:
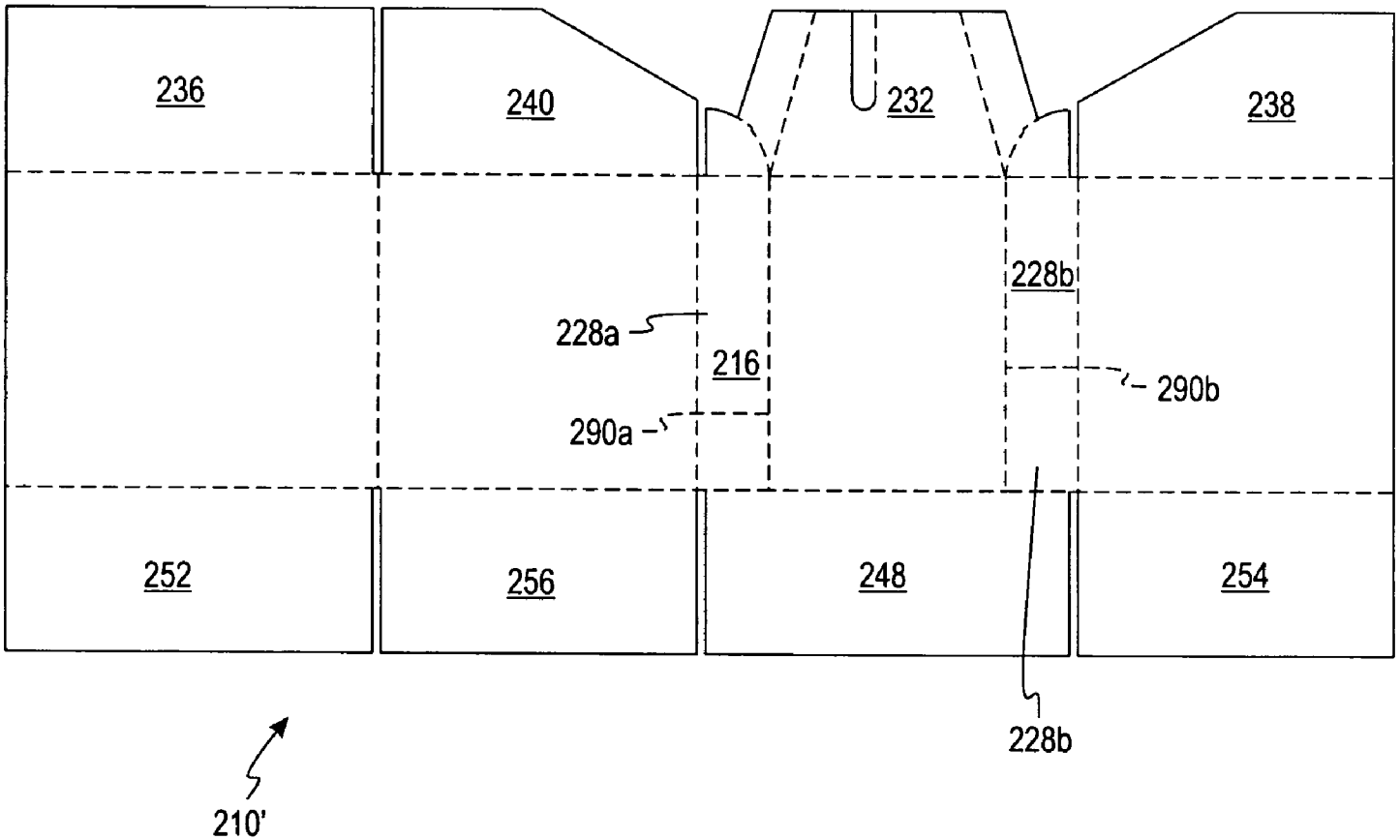
FIG. 6*c* is a plan view of a blank for forming the container of FIGS. 6*a,b*.

It is contemplated that the first bottom panel 48 may not include the run-over portion 58, as shown in the embodiment of FIGS. 6*a-c*. In such embodiments, a line of weakness may exist at the fold line 59 such that the access panel 29 may be detached and removed. Alternatively, the access panel may extend over less than the entire length of the front panel. The access panel of these embodiments is generally bound by one or more lines of weakness.

The container 10 further includes a integrated divider 62 (see FIGS. 2 and 4) comprised primarily of a stationary divider panel 64 and a removable section 65. The removable section 65 generally includes a removable divider panel 66, an adhesive panel 72, a bottom divider flap 76, and a leverage structure 78. The stationary divider panel is hingedly coupled to the first back panel 24 at a fold line 67. The stationary divider panel 64 is separated from the removable divider panel 66 by a line of weakness 68 generally opposite the fold line 67. The divider 62 vertically divides the container 10 of the illustrated embodiments into two compartments 70*a*, 70*b*. Thus, the combined width of the stationary divider panel 64 and the removable divider panel 66 is generally the same as the width of each of the generally parallel first and second side panels 20, 22. Although in the illustrated embodiment, the compartments 70*a*, 70*b* are generally equal in volume, it is contemplated that the compartments 70*a*, 70*b* may also have different volumes. It is also contemplated that the divider 62 may form more than two compartments, non-vertical compartments, combinations thereof, or the like.

The adhesive panel 72 of the removable divider portion 65 is hingedly coupled to the removable divider panel 66 along a fold line 73 generally opposite the line of weakness 68. The bottom divider flap 76 is hingedly coupled to a bottom end of the adhesive panel 73 along a fold line 77.

Figure 2:
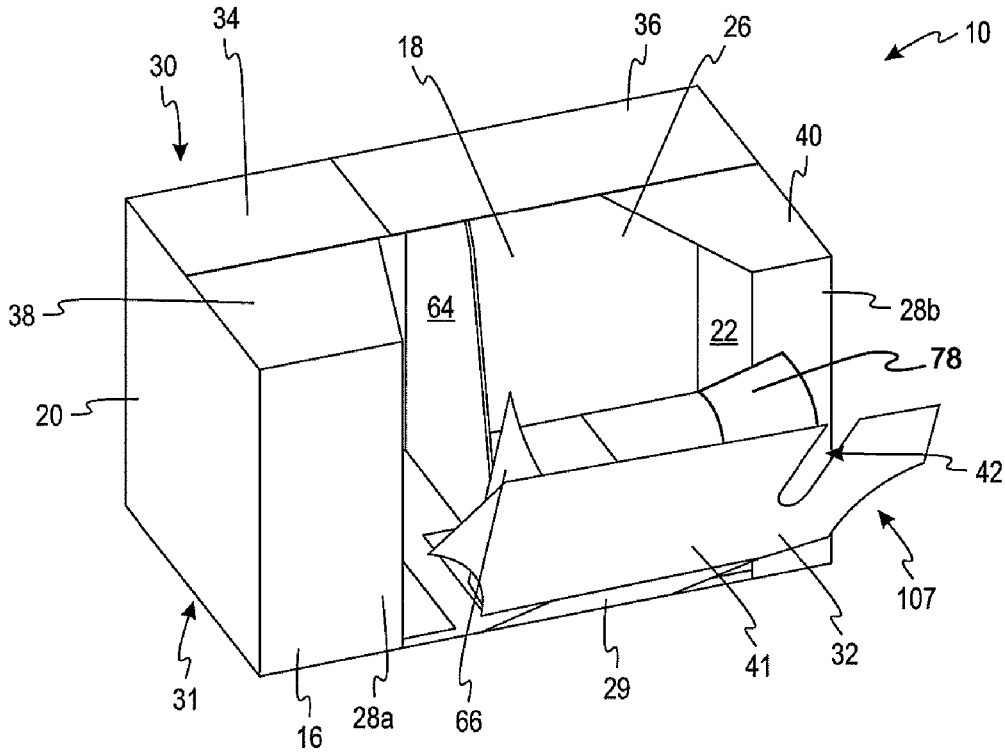
FIG. 2 is a top perspective view of the container of FIGS. 1*a-c* being converted from the shipper configuration to a display configuration.

As illustrated in FIGS. 2 and 4, the removable divider portion 65 also includes the leverage structure 78. In the illustrated embodiments, the leverage structure 78 is curved and includes a cut-out portion 79 generally separating the leverage structure 78 from a portion of the divider 62 (see FIG. 4). It is also contemplated that the leverage structure 78 may have other shapes. The leverage structure 78 includes a top divider flap 74 hingedly coupled to a top end of the adhesive panel 72 along a fold line 75. The leverage structure 78 of the illustrated embodiment includes a first leverage portion 80*a* hingedly coupled to a top end of the removable divider panel 66 along a fold line 81*a*. The leverage structure 78 further includes a second leverage portion 80*b* hingedly coupled to the top divider flap 74 along a fold line 81*b*. The first and second leverage portions 80*a*, 80*b* are separated by a fold line 82.

Turning now to FIG. 4, a plan view of a blank 10' for the formation of the container 10 of FIGS. 1-3*b* is shown. In addition to the panels and flaps previously described in connection with FIGS. 1-3*b*, the blank 10' includes a notch panel 85, a first reinforcing panel 87*a*, and a second reinforcing panel 87*b*. The notch panel 85 is integrated with the first top flap 32. A portion of the notch panel 85 is die cut from the first top flap 32 such that the notch panel 85 is adapted to be folded along a hinge or fold line 86 thereby forming the opening 42 (see FIGS. 1*a*, 1*c*) of the container 10.

The first and second reinforcing panels 87*a*, 87*b* are positioned between the respective first and second front end panels 28*a*, 28*b* and the access panel 29 and extend generally along the entire length of the front panel 16. To form the access openings 27*a*, 27*b* of FIGS. 1*a*, 1*b*, the first and second reinforcing panels 87*a*, 87*b* are die cut generally along portions of fold lines 59 and 88 and along opposing vertical edges 89*a*, 89*b* of the access panel 29. The first and second reinforcing panels 87*a*, 87*b* are attached to the respective first and second front end panels 28*a*, 28*b* along hinges or fold lines 90*a*, 90*b* separating the first and second reinforcing panels 87*a*, 87*b* from the respective first and second front end panels 28*a*, 28*b*. The access openings 27*a*, 27*b* are formed by folding the respective first and second reinforcing panels 87*a*, 87*b* along the respective fold lines 90*a*, 90*b* towards an interior side (i.e., the side adapted to contact the contents of the container 10) of the respective first and second front end panels 28*a*, 28*b* such that each of the reinforcing panels 87*a*, 87*b* is substantially flush with the interior side of the respective first and second front end panels 28*a*, 28*b*. The reinforcing panels 87*a*, 87*b* thus assist in reinforcing the front panel 16, thereby adding overall vertical support to the container 10 and allowing the container 10 to tolerate other containers, boxes, or the like being stacked on top of the container 10. Although the reinforcing panels 87*a*, 87*b* may also be folded toward an opposite, exterior side of the respective first and second front end panels 28*a*, 28*b*, it may be desirable that the reinforcing panels 87*a*, 87*b* be hidden from view.

To construct a container 10 as shown in FIGS. 1*a*-3*b* from the blank 10' of FIG. 4, the panels 20, 24, 64, 66, 73 forming a first side 92*a* of the blank 10' are folded along hinges or fold lines 94*a*, 94*b*, 67, 73 so that the top divider flap 74, the adhesive panel 72, and the bottom divider flap 76 are generally flush with the respective first top flap 32, the access panel 29, and the first bottom flap 48. According to one embodiment, the top divider flap 74 is attached to the first top flap 32 such that the top divider flap 74 is generally adjacent to the fold line 86 defining the notch panel 85. An adhesive is used to secure the top divider flap 74, the adhesive panel 72, the bottom divider flap 76, and/or portions thereof respectively to the first top flap 32, the access panel 29, and the run-over portion 58 or portions thereof. The adhesive may be applied prior to folding or subsequent to folding.

The panels comprising a second side 92*b* of the blank 10' are folded along hinges or fold lines 96*a*, 96*b* such that a portion of an outer end 98 of the second back panel 26 overlaps with a portion of an end of the first back panel 24 corresponding with the fold line 67, thereby forming a generally rectangular container. The width of the overlapping portion may vary depending upon the dimensions of the resulting container 10. An adhesive is used to secure the second back panel 26 to the first back panel 24. The first, second, third, fourth, and fifth bottom flaps 48, 50, 52, 54, 56 are then folded along hinges or fold lines 99*a*, 99*b*, 99*c*, 99*d*, 99*e* to form the bottom side 31. An adhesive may be used to secure the first, second, third, fourth, and fifth bottom flaps 48, 50, 52, 54, 56 to one another.

To form the top side 30 of the container 10, the first top flap 32 is first folded along hinge or fold lines 88, 100*a*, 100*b* separating the first top flap 32 from the front panel 16. Folding the first top flap 32 causes the attached leverage structure 78 to collapse at the fold line 82 such that the second leverage portion 80*b* is generally sandwiched between the top divider flap 74 and the first leverage portion 80*a*. The fold line 82 may include a feature suitable for assisting in collapsing the leverage structure 78 including, but not limited to, one or more apertures 102*a*. Other fold lines (e.g., fold lines 75, 77) may also include such apertures 102*b*, 102*c*, for example, to weaken the respective fold lines 75, 77. Next, the fourth and fifth top flaps 38, 40 are folded along respective hinges or fold lines 104*a*, 104*b* separating the fourth and fifth top flaps 38, 40 from the respective first and second side panels 20, 22. The fourth and fifth top flaps 38, 40 generally form an aperture through which the main top portion 41 may be pulled during conversion of the container 10 from the shipper configuration of FIGS. 1*a-c* to a display configuration of FIGS. 3*a*, 3*b*. Finally, the second and third top flaps 34, 36 are folded along respective hinges or fold lines 106*a*, 106*b* separating the second and third top flaps 34, 36 from the respective first and second back panels 24, 26. An adhesive may be used to secure the first, second, third, fourth, and fifth top flaps 32, 34, 36, 38, 40 to one another. It should be noted that, where appropriate, the order of the acts performed to construct the container 10 may be varied.

The contents may be placed into the container 10 prior to assembling one of the top side 30 and the bottom side 31. The contents are generally placed on either side of the divider 62, and a portion of the contents may be viewed through the access openings 27*a*, 27*b*, as shown in FIG. 1*a*.

Figure 3A:
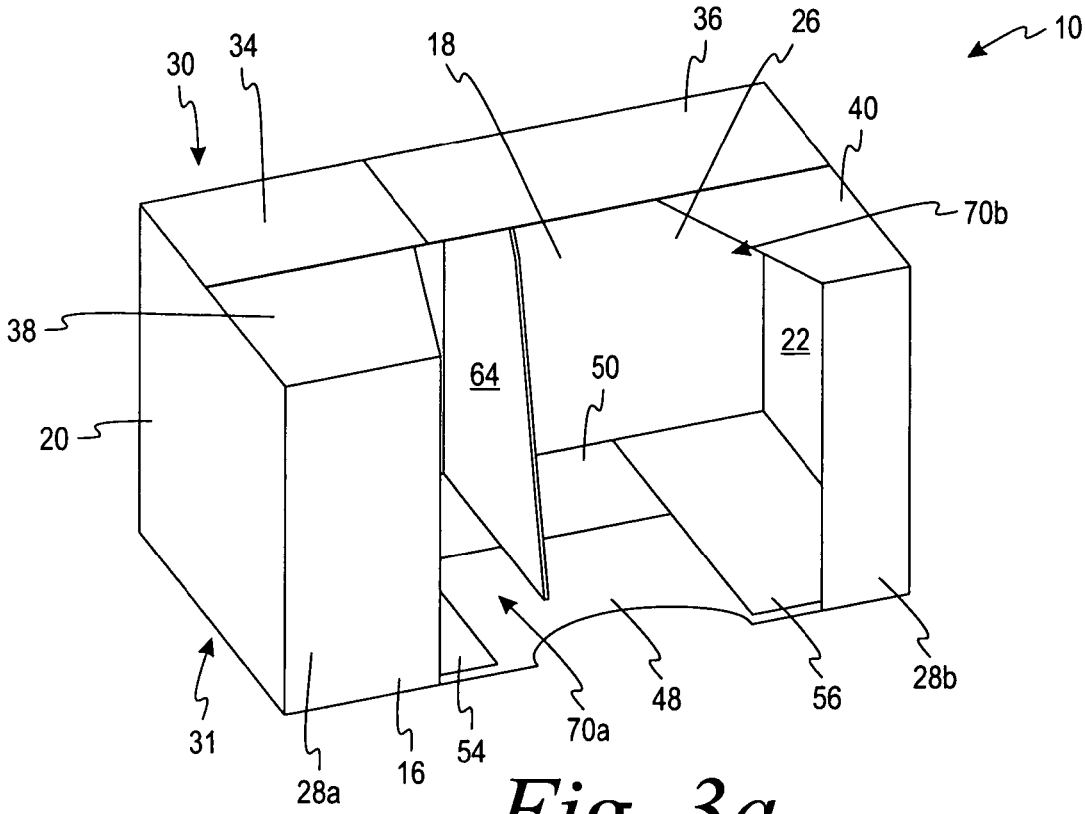
FIG. 3*a* is a top perspective view of the container of FIGS. 1*a-c* and 2 in a display configuration.
Figure 3B:
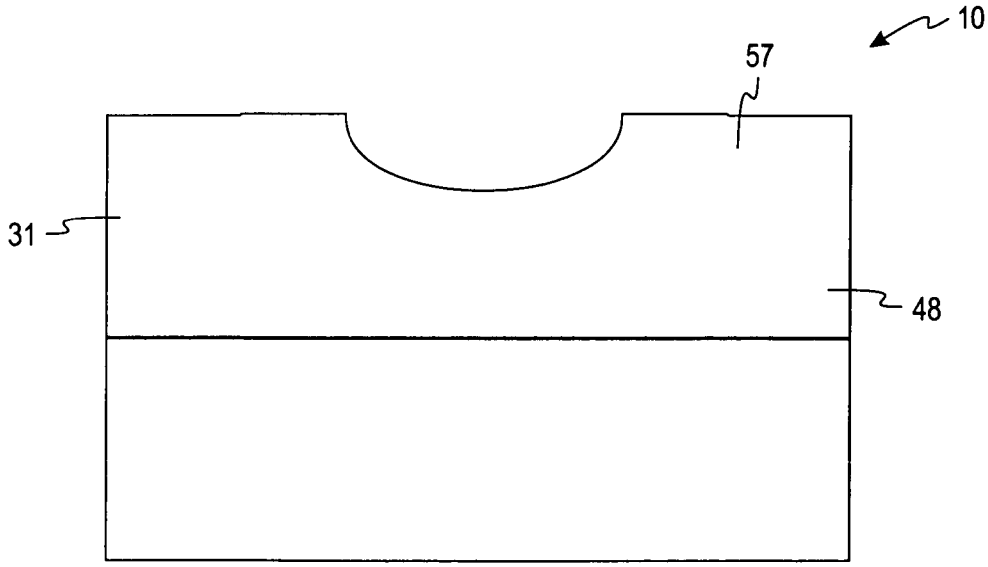
FIG. 3*b* is a bottom view of the container of FIG. 3*a*.

To convert the container 10 from the shipper configuration of FIGS. 1*a-c* to the display configuration of FIGS. 3*a,b*, a detachable portion 107 (FIG. 2) comprising the main top portion 41, the access panel 29, the run-over portion 58, and the removable divider portion 65 are detached from the container 10. A user may grasp and pull the first top flap 32 through the aperture formed by the fourth and fifth top flaps 38, 40 in the direction of Arrow A by, for example, placing one or more fingers through the opening 42. In one embodiment, the user simultaneously grasps the top divider flap 74, thereby simultaneously pulling the leverage structure 78 and, accordingly, the removable divider panel 66. As shown in FIG. 2, as the user continues to pull the first top flap 32 through the aperture formed by the fourth and fifth top flaps 38, 40, the main top portion 41 of the first top flap 32 separates from the support panels 44*a*, 44*b*, the removable divider panel 66 separates from the stationary divider panel 64, and, finally, the run-over portion 58 separates from the first bottom flap 48 at the respective lines of weakness 46*a*, 46*b*, 68, 60. FIGS. 3*a,b* illustrate the resulting container 10 in the display configuration. The contents of the container 10 are readily viewable and accessible to the user and to consumers.

The containers 10 of the embodiments described herein provide several advantages. For example, by attaching the divider 62 to the access panel 29, the divider 62 assists in holding the access panel 29 in the plane of the front panel 16 and inhibiting the lines of weakness 46*a*, 46*b*, 60 from being ruptured. Thus, the access panel 29 is less likely to be pushed out from the container 10. Accordingly, the lines of weakness 46*a*, 46*b*, 60 may be less robust, thereby decreasing the force that a user is required to apply to remove the detachable portion 107. Furthermore, the divider 62 provides added robustness to the shipping performance of the container 10. For example, in addition to the other lines of weakness 46*a*, 46*b*, 60, the line of weakness 68 associated with the removable divider portion 65 would need to be ruptured for the access panel 29 to be pushed out. Additionally, the line of weakness 68 is inside of the container 10 and is, thus, not exposed to external hazards. Moreover, because a user ruptures the lines of weakness 46*a*, 46*b*, 60, 68 in succession rather than simultaneously, the overall effort required by the user to remove the detachable portion 107 remains low.

The leverage structure 78 of the embodiments described herein provides additional advantages. The placement of the leverage structure 78 provides a mechanical advantage to assist in rupturing the line of weakness 68. Attaching the top divider flap 74 of the leverage structure 78 to the first top flap 32 and attaching the first leverage portion 80*a* near the line of weakness 68 in the divider 62 allows the line of weakness 68 to be more robust while not sacrificing the ease in which the detachable portion 107 may be removed from the container 10. Additionally, the leverage structure 78 assists in enabling a user to complete the removal of the detachable portion 107 from a single grip position, thus resulting in a relatively quick and convenient conversion from the shipper configuration (FIGS. 1*a*-1*c*) to the display configuration (FIGS. 3*a,b*).

The support panels 44*a*, 44*b* of the container 10 of the embodiments described herein also provide several advantages. For example, the support panels 44*a*, 44*b* provide additional attachment points (i.e., the lines of weakness 46*a*, 46*b*) for the main top portion 41 and, thus, for the detachable portion 107. The lines of weakness 46*a*, 46*b* are generally covered by the respective fifth and fourth top flaps 40, 38, thereby protecting the lines of weakness 46*a*, 46*b* from both external and internal shipping hazards. Moreover, the support panels 44*a*, 44*b* allow for the main top portion 41 to be more readily pulled through the aperture formed by the fourth and fifth top portions 38, 40 and pulled out from under the second, third, fourth, and fifth top panels 34, 36, 38, 40. In pulling the main top portion 41, the support panels 44*a*, 44*b* are retained under the respective fifth and fourth top flaps 38, 40. As the main top portion 41 of the first top flap 32 moves upward during the act of pulling, the main portion 41 bends at the fold lines 47*a*, 47*b*, and the outer portions of the first top flap 32 are forced downward by the respective fifth and fourth top flaps 40, 38, thereby further assisting in rupturing the lines of weakness 46*a*, 46*b* between the main top portion 41 and the support panels 44*a*, 44*b*. This rupture assistance allows for more robust lines of weakness 46*a*, 46*b* to be used. Yet a further benefit of the support panels 44*a*, 44*b* is that they provide support for the fourth and fifth top flaps 38, 40 so that, for example, containers stacked above will not nest into containers stacked below.

The optional run-over portion 58 also provides added benefits to the container 10. For example, the run-over portion 58 allows the access panel 29 to be extended along the entire length of the container 10 to allow a full vertical window from which to view and access the contents of the container 10 while avoiding rupturing problems often encountered when a line of weakness is positioned along a hinge or fold line 59, 99*a*, 99*b* at the bottom 31 of the container 10. Because the bottom divider flap 76 is adhesively attached to the run-over portion 58, the bottom divider flap 76 assists in rotating the run-over portion 58 at the fold line 59 and in keeping the run-over portion 58 in the plane of the main bottom portion 57 of the first bottom flap 48, thereby alleviating stress that might normally cause the line of weakness 60 to rupture and separate the run-over portion 58 from the main bottom portion 57. The bottom divider flap 76 also assists in protecting a portion of the line of weakness 60 from internal hazards tending to push the run-over portion 58 out of the container 10 and from external hazards tending to push the run-over portion 58 into the container 10.

Moreover, the containers 10 of the embodiments described herein are aesthetically pleasing. After the detachable portion 107 has been removed and the container 10 is in the display configuration (FIGS. 3*a,b*), all of the rough edges corresponding with severed lines of weakness 46*a*, 46*b*, 60, 68 are generally hidden from a consumer's view. Thus, only the smoother, die cut lines (e.g., vertical edges 89*a*, 89*b* of the access panel 29) and folded lines (e.g., fold lines 90*a*, 90*b*) are viewable, which may be desirable from a marketing standpoint.

Figure 5A:
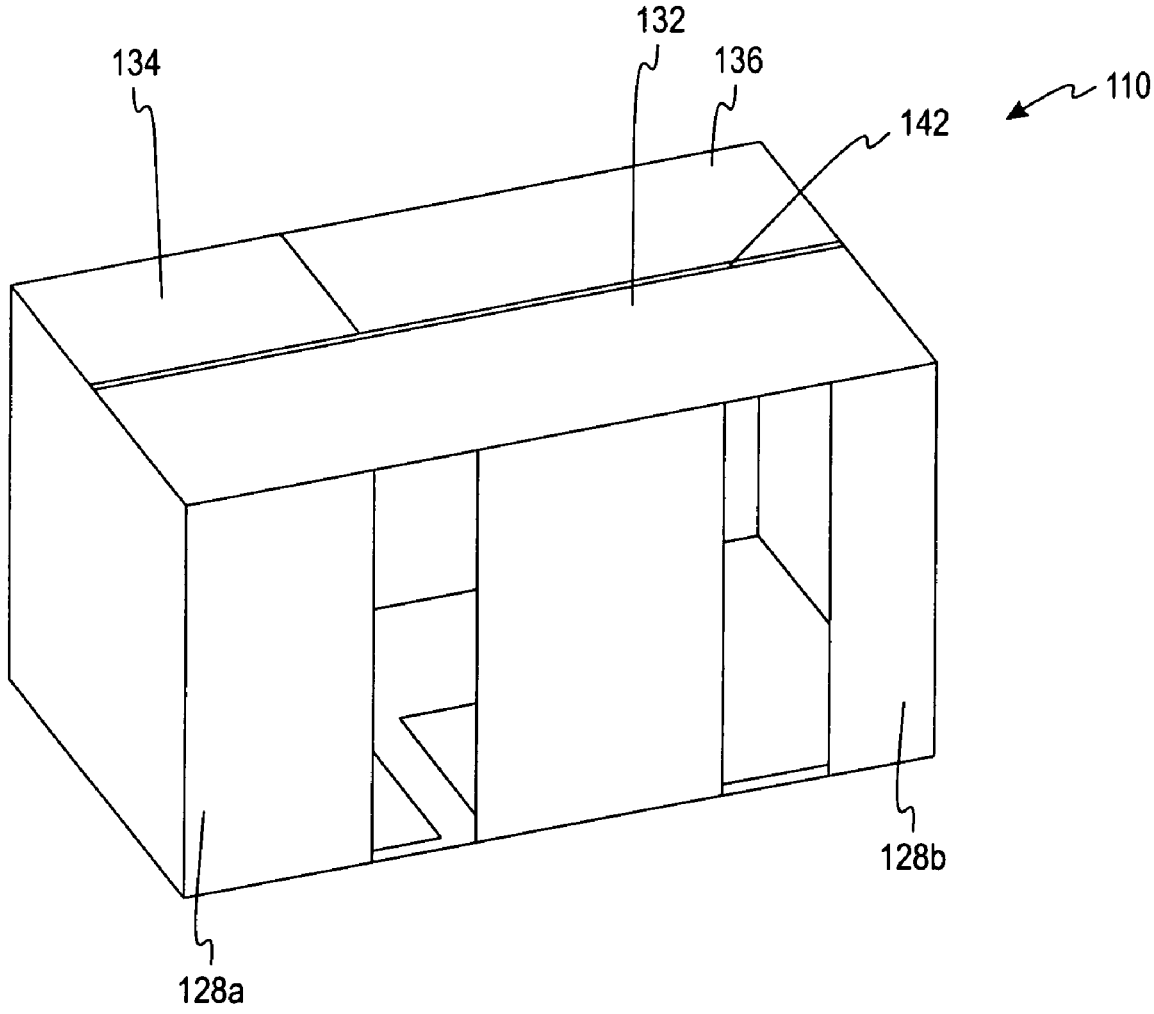
FIG. 5*a* is a top perspective view of a container according to another embodiment of the present invention.
Figure 5B:
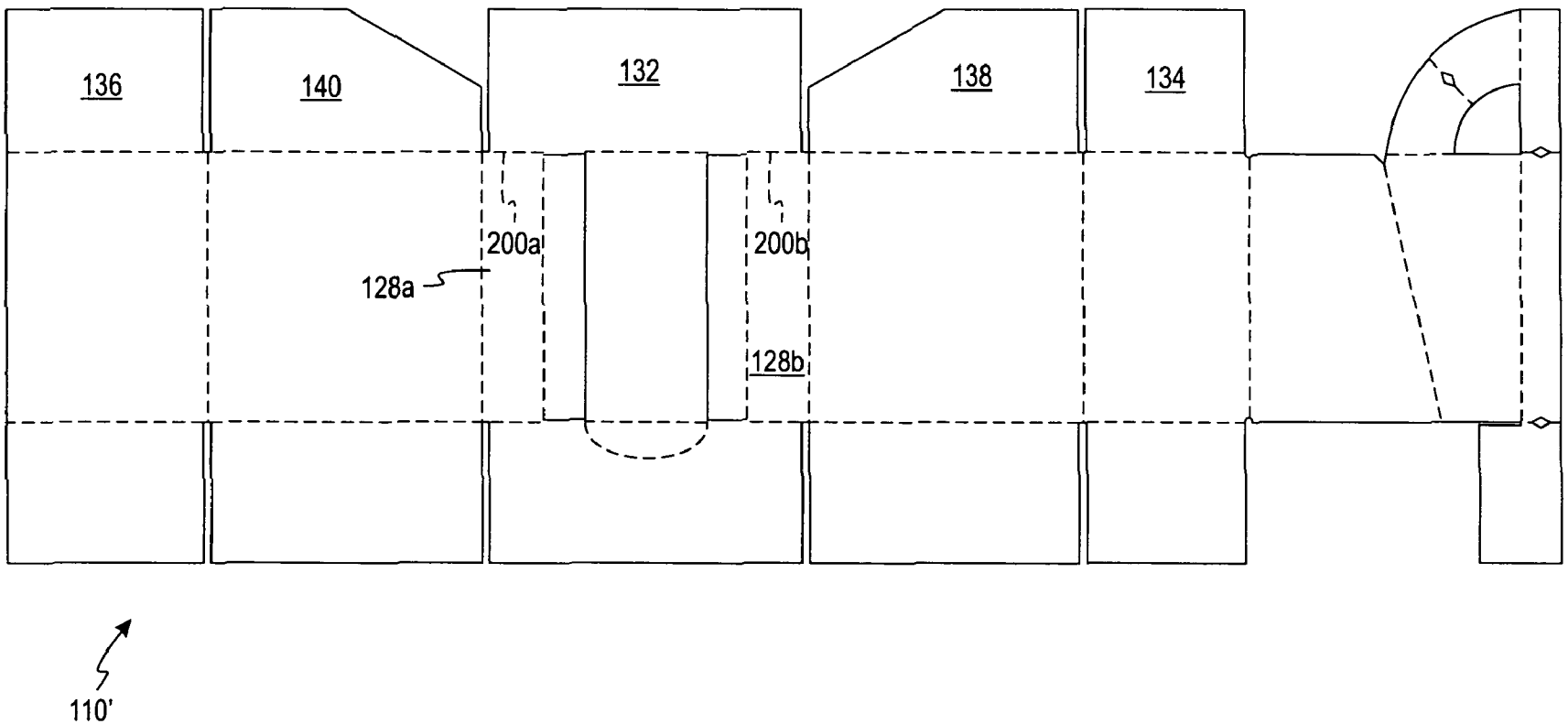
FIG. 5*b* is a plan view of a blank for forming the container of FIG. 5*a*.

Turning now to FIGS. 5*a,b*, a container 110 and blank 110' for forming the container 110 are shown according to another embodiment. The container 110 is generally similar to the container 10 of FIGS. 1*a*-3*c*. However, the container 110 includes a generally uniform first top flap 132. In a shipper configuration of FIG. 5*a*, the first top flap 132 is positioned over second, third, fourth, and fifth top flaps 134, 136, 138, 140 (in any order). In this embodiment, the first top flap 132 is coupled to first and second front end panels 128*a*, 128*b* by respective lines of weakness 200*a*, 200*b*. As shown in FIG. 5*a*, the first top flap 132 is attached to one or more of the second, third, fourth, and fifth top flaps 134, 136, 138, and 140 by, for example, a zipper-type pull tab 142. Other suitable ways of attaching the first top flap 132 to the other top flaps 134, 136, 138, 140 may also be used.

Turning now to FIGS. 6*a-c*, a container 210 and blank 210' for forming the container 210 are shown according to yet another embodiment. The container 210 differs from the containers 10 of FIGS. 1*a*-3*c* in that the container 210 does not include an integral divider. Furthermore, the container 210 includes a single back panel 226. Accordingly, the container 210 includes first, second, third, and fourth top flaps 232, 234, 236, 238 and first, second, third, and fourth bottom flaps 248, 252, 254, 256. The width of the back panel 226 is generally similar to the width of an opposing front panel 216. The front panel 216 includes opposing front end panels 228*a*, 228*b* and an access panel 229 positioned therebetween. The access panel 229 is separated from the front end panels 228*a*, 228*b* by lines of weakness 290*a*, 290*b*. Although the container 210 is shown without a run-over portion (e.g., run-over portion 58 of FIGS. 1*a*-4) on the first bottom flap 248 (see FIG. 6*b*), it is contemplated that the container 210 may include a run-over portion. The container 210 and blank 210' may include various other features described above in connection with the container 10 of FIGS. 1*a*-4.

The containers of the embodiments described herein are typically manufactured using corrugated paperboard, preferably with the corrugations running in a vertical direction for increased strength. It is to be understood that the principles of this invention could be applied to containers made of other materials, such as non-corrugated paperboards, cardboard, corrugated fiberboard, non-corrugated fiberboard, solid-fiber board, polymeric materials, and other foldable materials. It is also contemplated that the container 10 may include advertising features, graphics, or the like.

Although the embodiments of the containers previously described and depicted include generally rectangular cross sections, it is contemplated that the containers of the present invention may have non-rectangular cross sections. It is contemplated that a container may have a polygonal cross section, such as a triangle, square, hexagon, octagon, pentagon, or the like. It is further contemplated that a container may have a non-polygonal cross section, such as a circle or an oval.

According to alternative embodiment A, a container comprises a front panel, a first back panel, a second back panel, a first side panel bridging the front panel and the first back panel, a second side panel bridging the front panel and the second back panel, a top portion, and a bottom portion, the front panel, first and second back panels, first and second side panels, top portion, and bottom portion defining an interior of the container, a divider extending from the first back panel into the interior of the container and being attached to the front panel, the divider being operable to divide the interior of the container into two or more compartments, and a detachable portion comprising a removable section of the top portion, a removable section of the front panel, and a removable section of the divider, the detachable portion being separable from the container along a plurality of lines of weakness.

According to alternative embodiment B, the container of alternative embodiment A, wherein the lines of weakness include perforations.

According to alternative embodiment C, the container of alternative embodiment A, wherein the detachable portion further includes a removable section of the bottom portion.

According to alternative embodiment D, the container of alternative embodiment C, wherein the removable section of the top portion is hingedly coupled to a first end of the removable section of the front panel, and the removable section of the bottom portion is hingedly coupled to a second, generally opposite end of the removable section of the front panel.

According to alternative embodiment E, the container of alternative embodiment A, wherein a first end of the removable section of the divider is adhesively attached to the removable section of the front panel and a second, generally opposite end of the removable section of the divider is attached to a stationary portion of the divider along a line of weakness.

According to alternative embodiment F, the container of alternative embodiment A, wherein the detachable portion further comprises a leverage structure, a first end of the leverage structure being hingedly coupled to the removable section of the divider and a second end of the leverage structure being attached to the removable section of the top portion.

According to alternative embodiment G, the container of alternative embodiment A, wherein the removable section of the front panel is positioned between a first and second access opening.

According to alternative embodiment H, the container of alternative embodiment G, wherein the front panel further includes a first and second reinforcing panel, the first and second reinforcing panels being folded toward opposing first and second front end panels of the front panel, thereby forming the first and second access opening.

According to alternative embodiment I, the container of alternative embodiment A, wherein the removable section of the top portion forms an opening adapted to allow a user to grasp the removable section of the top portion.

According to alternative embodiment J, the container of alternative embodiment A, wherein the front panel, the first and second back panels, the first and second side panels, the top portion, the bottom portion, and the divider are comprised of paperboard.

According to alternative embodiment K, the container of alternative embodiment A, wherein the removable section of the top portion includes a first top flap extending from the front panel, the first top flap being positioned over a remaining portion of the top portion.

According to alternative embodiment L, a container comprises a front panel, a first back panel, a second back panel, a first side panel bridging the front panel and the first back panel, and a second side panel bridging the front panel and the second back panel, the front panel including first and second front end panels positioned along opposing vertical ends of the front panel, first and second access openings positioned adjacent to inner ends of the first and second front end panels, and an access panel positioned between the first and second access openings, a top portion comprising a first top flap extending from the front panel, a second top flap extending from the first back panel, a third top flap extending from the second back panel, a fourth top flap extending from the first side panel, and a fifth top flap extending from the second side panel, a bottom portion comprising a first bottom flap extending from the front panel, a second bottom flap extending from the first back panel, a third bottom flap extending from the second back panel, a fourth bottom flap extending from the first side panel, and a fifth bottom flap extending from the second side panel, a divider hingedly coupled to the first back panel, the divider being separated into a first divider portion and a second divider portion by a line of weakness, the first divider portion being attached to an interior surface of the front panel, and a detachable portion including at least a portion of the first top flap, the access panel, and the first divider portion.

According to alternative embodiment M, the container of alternative embodiment L, wherein the detachable portion further includes at least a portion of the first bottom flap.

According to alternative embodiment N, the container of alternative embodiment M, wherein the detachable portion of the first bottom flap includes a run-over portion hingedly coupled to the access panel and separated from a remaining portion of the first bottom flap by a line of weakness.

According to alternative embodiment O, the container of alternative embodiment M, wherein the first divider portion includes a bottom divider panel, the bottom divider panel being attached to the detachable portion of the first bottom flap.

According to alternative embodiment P, the container of alternative embodiment L, wherein the first divider portion comprises a leverage structure, a first end of the leverage structure being adhesively attached to the first top flap.

According to alternative embodiment Q, the container of alternative embodiment L, wherein the first top flap includes opposing first and second support panels hingedly coupled to the front panel, the first and second support panels being separated from a remaining portion of the first top flap by lines of weakness.

According to alternative embodiment R, the container of alternative embodiment P, wherein external surfaces of the first and second support panels are generally flush with interior surfaces of the fourth and fifth top flaps.

According to alternative embodiment S, the container of alternative embodiment L, wherein the first top flap further comprises an opening adapted to allow a user to grasp the first top flap.

According to alternative embodiment T, the container of alternative embodiment L, further including first and second reinforcing panels hingedly coupled to the inner ends of the first and second front end panels, the first and second reinforcing panels being generally flush with the first and second front end panels.

According to alternative embodiment U, a container comprises a front panel, an opposing back panel, a first side panel bridging the front and the back panels, and a second side panel bridging the front and the back panels, the front panel including first and second front end panels positioned along opposing vertical ends of the front panel and an access panel positioned between the first and second access openings, a top portion comprising a first top flap extending from the front panel, a second top flap extending from the back panel, a third top flap extending from the first side panel, and a fourth top flap extending from the second side panel, the first top flap including a main portion and opposing first and second support panels hingedly coupled to the respective first and second end panels, the first and second support panels being separated from the main portion by respective lines of weakness, a bottom portion comprising a first bottom flap extending from the front panel, a second bottom flap extending from the back panel, a third bottom flap extending from the first side panel, and a fourth bottom flap extending from the second side panel, and a detachable portion comprising the main portion of the top portion and the access panel, the detachable portion being separable from the container along a plurality of lines of weakness.

According to alternative embodiment V, the container of alternative embodiment U, wherein the detachable portion further includes at least a portion of the first bottom flap.

According to alternative embodiment W, the container of alternative embodiment V, wherein the detachable portion of the first bottom flap includes a run-over portion hingedly coupled to the access panel and separated from a remaining portion of the first bottom flap by a line of weakness.

According to alternative embodiment X, the container of alternative embodiment U, wherein external surfaces of the first and second support panels are generally flush with interior surfaces of the fourth and fifth top flaps.

According to alternative embodiment Y, the container of alternative embodiment U, wherein the first top flap further comprises an opening adapted to allow a user to grasp the first top flap.

According to alternative process Z, a method of using a container, the method comprises the acts of providing a container having a front panel, a first back panel, a second back panel, a first side panel bridging the front panel and the first back panel, a second side panel bridging the front panel and the second back panel, a top portion, a bottom portion, and a divider, the front panel, first and second back panels, first and second side panels, top portion, and bottom portion defining an interior of the container, the divider extending from the first back panel into the interior of the container and being attached to the front panel, the divider being operable to divide the interior of the container into two or more compartments, converting the container from a shipper configuration to a display configuration by detaching a detachable portion, the detachable portion comprising a removable section of the top portion, a removable section of the front panel, and a removable section of the divider, the detachable portion being separable from the container along a plurality of lines of weakness.

According to alternative process AA, a method of using a container comprises providing a container comprising a front panel, an opposing back panel, a first side panel bridging the front and the back panels, a second side panel bridging the front and the back panels, a top portion, and a bottom portion, the front panel including first and second front end panels positioned along opposing vertical ends of the front panel and an access panel positioned between the first and second access openings, the top portion comprising a first top flap extending from the front panel, the first top flap including a main portion and opposing first and second support panels hingedly coupled to the respective first and second end panels, the first and second support panels being separated from the main portion by respective lines of weakness, and converting the container from a shipper configuration to a display configuration by removing a detachable portion, the detachable portion comprising the main portion of the top portion and the access panel, the detachable portion being separable from the container along a plurality of lines of weakness.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container comprising:

a front panel, a first back panel, a second back panel, a first side panel bridging the front panel and the first back panel, a second side panel bridging the front panel and the second back panel, a top portion, and a bottom portion, the front panel, first and second back panels, first and second side panels, top portion, and bottom portion defining an interior of the container;

a divider extending from the first back panel into the interior of the container and being attached to the front panel, the divider being operable to divide the interior of the container into two or more compartments; and a detachable portion comprising a removable section of the top portion, a removable section of the front panel, and a removable section of the divider, the detachable portion being separable from the container along a plurality of lines of weakness.

2. The container of claim 1, wherein the detachable portion further includes a removable section of the bottom portion.

3. The container of claim 2, wherein the removable section of the top portion is hingedly coupled to a first end of the removable section of the front panel, and the removable section of the bottom portion is hingedly coupled to a second, generally opposite end of the removable section of the front panel.

4. The container of claim 1, wherein a first end of the removable section of the divider is adhesively attached to the removable section of the front panel and a second, generally opposite end of the removable section of the divider is attached to a stationary portion of the divider along a line of weakness.

5. The container of claim 1, wherein the detachable portion further comprises a leverage structure, a first end of the leverage structure being hingedly coupled to the removable section of the divider and a second end of the leverage structure being attached to the removable section of the top portion.

6. The container of claim 1, wherein the removable section of the front panel is positioned between a first and second access opening.

7. The container of claim 6, wherein the front panel further includes a first and second reinforcing panel, the first and second reinforcing panels being folded toward opposing first and second front end panels of the front panel, thereby forming the first and second access opening.

8. The container of claim 1, wherein the removable section of the top portion forms an opening adapted to allow a user to grasp the removable section of the top portion.

9. The container of claim 1, wherein the removable section of the top portion includes a first top flap extending from the front panel, the first top flap being positioned over a remaining portion of the top portion.

10. A container comprising:

a front panel, a first back panel, a second back panel, a first side panel bridging the front panel and the first back panel, and a second side panel bridging the front panel and the second back panel, the front panel including first and second front end panels positioned along opposing vertical ends of the front panel, first and second access openings positioned adjacent to inner ends of the first and second front end panels, and an access panel positioned between the first and second access openings;

a top portion comprising a first top flap extending from the front panel, a second top flap extending from the first back panel, a third top flap extending from the second back panel, a fourth top flap extending from the first side panel, and a fifth top flap extending from the second side panel;

a bottom portion comprising a first bottom flap extending from the front panel, a second bottom flap extending from the first back panel, a third bottom flap extending from the second back panel, a fourth bottom flap extending from the first side panel, and a fifth bottom flap extending from the second side panel;

a divider hingedly coupled to the first back panel, the divider being separated into a first divider portion and a second divider portion by a line of weakness, the first divider portion being attached to an interior surface of the front panel; and a detachable portion including at least a portion of the first top flap, the access panel, and the first divider portion.

11. The container of claim 10, wherein the detachable portion further includes at least a portion of the first bottom flap.

12. The container of claim 11, wherein the detachable portion of the first bottom flap includes a run-over portion hingedly coupled to the access panel and separated from a remaining portion of the first bottom flap by a line of weakness.

13. The container of claim 11, wherein the first divider portion includes a bottom divider flap, the bottom divider flap being attached to the detachable portion of the first bottom flap.

14. The container of claim 10, wherein the first divider portion comprises a leverage structure, a first end of the leverage structure being adhesively attached to the first top flap.

15. The container of claim 10, wherein the first top flap includes opposing first and second support panels hingedly coupled to the front panel, the first and second support panels being separated from a remaining portion of the first top flap by lines of weakness.

16. The container of claim 15, wherein external surfaces of the first and second support panels are generally flush with interior surfaces of the fourth and fifth top flaps.

17. The container of claim 10, wherein the first top flap further comprises an opening adapted to allow a user to grasp the first top flap.

18. The container of claim 10, further including first and second reinforcing panels hingedly coupled to the inner ends of the first and second front end panels, the first and second reinforcing panels being generally flush with the first and second front end panels.

19. The container of claim 10, wherein the line of weakness separating the first and second divider portions is generally vertical.

20. The container of claim 14, wherein a second end of the leverage structure is hingedly coupled to a top end of the first divider portion.

21. The container of claim 1, wherein the top portion includes a first top flap extending from the front panel, a second top flap extending from the back panel, a third top flap extending from the first side panel, and a fourth top flap extending from the second side panel, the first top flap including a main portion and opposing first and second support panels hingedly coupled to the respective first and second end panels, the first and second support panels being separated from the main portion by respective lines of weakness.

22. The container of claim 21, wherein external surfaces of the first and second support panels are generally flush with interior surfaces of the third and fourth top flaps.

23. The container of claim 5, wherein the first end of the leverage structure is hingedly coupled to a top end of the removable section of the divider.

* * * * *